US008329014B2

(12) United States Patent
Takahashi et al.

(10) Patent No.: US 8,329,014 B2
(45) Date of Patent: Dec. 11, 2012

(54) VEHICLE BODY PRODUCTION METHOD

(75) Inventors: Masaki Takahashi, Tokyo (JP); Yasuhiro Kume, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 355 days.

(21) Appl. No.: 12/738,128

(22) PCT Filed: Mar. 10, 2009

(86) PCT No.: PCT/JP2009/054513

§ 371 (c)(1),
(2), (4) Date: Apr. 15, 2010

(87) PCT Pub. No.: WO2009/116428

PCT Pub. Date: Sep. 24, 2009

(65) Prior Publication Data

US 2010/0224500 A1 Sep. 9, 2010

(30) Foreign Application Priority Data

Mar. 19, 2008 (JP) ..... 2008-072409

(51) Int. Cl.

| | |
|---|---|
| ***C25D 13/06*** | (2006.01) |
| ***C25D 13/20*** | (2006.01) |
| ***C23F 17/00*** | (2006.01) |

(52) U.S. Cl. ..... 204/510; 204/486; 204/487; 204/488

(58) Field of Classification Search ..... 427/409; 204/486–488, 510

See application file for complete search history.

(56) References Cited

U.S. PATENT DOCUMENTS

| | | | | |
|---|---|---|---|---|
| 2006/0068094 | A1* | 3/2006 | Cole | 427/240 |
| 2006/0222875 | A1* | 10/2006 | Sormani et al. | 428/500 |
| 2007/0048441 | A1 | 3/2007 | Braun et al. | |
| 2009/0075028 | A1* | 3/2009 | Suzuki et al. | 428/172 |

FOREIGN PATENT DOCUMENTS

| | | | |
|---|---|---|---|
| CN | 1482216 | A | 3/2004 |
| FR | 2 568 824 | A1 | 2/1986 |
| JP | 05-015846 | A | 1/1993 |
| JP | 08-155812 | | 6/1996 |
| JP | 08-187652 | | 7/1996 |
| JP | 10-099779 | | 4/1998 |
| JP | 11-005051 | | 1/1999 |
| JP | 2005-081274 | | 3/2005 |
| JP | 2007-229671 | | 9/2007 |
| WO | 2007/027286 | A2 | 3/2007 |

* cited by examiner

*Primary Examiner* — Bruce Bell

(74) *Attorney, Agent, or Firm* — Carrier Blackman & Associates, P.C.; Joseph P. Carrier; William D. Blackman

(57) ABSTRACT

Disclosed is a method for producing a vehicle body, which, without removing protrusions on an electrophoretic coating, improves the coating quality. The outer surface of the vehicle body is sanded prior to a pre-treatment, where the vehicle body is degreased and washed.

7 Claims, 10 Drawing Sheets

PRIOR ART

VEHICLE BODY PRODUCTION METHOD

TECHNICAL FIELD

The present invention relates to a vehicle body production method.

BACKGROUND ART

In the process of coating a vehicle body, a baking process for heating the coated surface is usually performed after each of an electrodeposition coating, a middle coat coating, a top coat base coating, and a top coat clear coating has been performed. The number of drying furnaces increases when such a large number of baking treatments are performed, and the amount of heat used by the coating process therefore increases. There is a need to reduce the amount of heat for the sake of energy conservation.

The present inventors have previously proposed a vehicle body production method whereby the amount of heat needed to heat a coated surface can be reduced (see Japanese Patent Application Laid-Open Publication No. 2007-229671=Patent Document 1).

FIG. 11 hereof shows the conventional vehicle body production method disclosed in Patent Document 1. As shown in FIG. 11, in step (hereinafter abbreviated as ST) 01, an electrophoretic coating (also called "electrodeposition coating") is applied to the surface of a vehicle body, and the electrodeposited surface is heated for 20 minutes at 170° C. In ST02, a middle coat coating is applied to the electrodeposition coating. In ST03, the middle coat coated surface is heated for 5 minutes at 70° C. as a first preheating. In ST04, a top coat base coating is applied on the middle coat coated surface. In ST05, the top coat base coated surface is heated for 10 minutes at 80° C. as a second preheating. In ST06, a top coat clear coating is applied on the top coat base coated surface. In ST07, the top coat clear coated surface is heated for 30 minutes at 140° C.

Since heat is applied at a lower temperature and for a shorter time in the first preheating of ST03 and the second preheating of ST05 than in the heating of ST07, the amount of heat needed for heating can be reduced. Such a coating method involves a single heating after three coatings, and is therefore referred to as "three-coat/one-bake" system Protrusions sometimes appear on the surface of the base electrodeposition coating. The protrusions adversely affect the appearance of the coating, and must therefore be removed to smooth the coating surface. Patent Document 2 discloses a conventional vehicle body production method that includes polishing as an operation for smoothing the electrodeposited surface after the electrodeposition coating is formed.

FIG. 12 hereof shows the conventional vehicle body production method including the polishing operation as disclosed in Japanese Patent Application Laid-Open Publication No. 8-187652 (Patent Document 2). In FIG. 12, the vehicle body is conveyed from left to right. An electrodeposition coating device 300 is composed of an electrodeposition coating bath 302 for applying an electrodeposition coating to a vehicle body 301, a rinsing section 303 for removing excess electrodeposition paint adhering to the vehicle body 301, a vehicle body transfer section 304, a drying furnace 305 for heating the electrodeposited surface of the vehicle body 301, and a polishing section 306 in which polishing of the electrodeposition coating on the outer surface of the vehicle body 301 is performed by a human operator.

In the electrodeposition coating device 300 of Patent Document 2, since the surface of the electrodeposition coating is polished in the polishing section 306, any protrusions that may have formed on the surface of the electrodeposition coating are removed, and a smooth coating surface can be obtained.

However, since the thickness of the electrodeposition coating is very small; i.e., on the order of several tens of micrometers, caution is taken during the polishing so as not to peel off the coating. When polishing is performed carefully, the amount of polishing is deficient to remove an adequate amount of the protrusions, and there is a risk of the protrusions remaining.

The middle coat coating shown in ST02, the top coat base coating shown in ST04, and the top coat clear coating shown in ST06 of FIG. 10 are applied on the electrodeposition coating in which the protrusions remain. When the heating shown in ST07 is then performed, the middle coat coating, top coat base coating, and top coat clear coating conform to the shape of the protrusions as viewed in cross-section, and protrusions therefore appear on the surface of the top coat clear coating. The quality of the coating is reduced when such protrusions occur on the outer surface of the vehicle body.

DISCLOSURE OF THE INVENTION

An object of the present invention is to provide a vehicle body production method which is capable of improving the coating quality without performing the removing of protrusions on the electrodeposition coating.

According to a first aspect of the present invention, there is provided a method for producing a vehicle body in which a middle coat coating and a top coat coating are applied to a vehicle body after the vehicle body has been subjected to a pre-treatment process where the vehicle body is degreased, washed, or subjected to other treatments, the vehicle body production method characterized by comprising: a sanding process for improving the surface roughness of an outer surface of the vehicle body prior to the pre-treatment process.

By performing the sanding process prior to the pre-treatment process in this manner, there is no need to add a washing process and a drying process after the vehicle body has been sanded, and a vehicle body production method employing a compact coating line can therefore be provided. The thus provided vehicle body production method is capable of saving energy and reducing the amount of emitted $CO_2$.

Preferably, a middle coat coating paint used in the middle coat coating is a two-component paint having an isocyanate compound as a cross-linking agent.

The present inventors have confirmed that the middle coat coating and top coat coating can be prevented from curing in a state of mixture with each other by using a two-component middle coat coating paint having an isocyanate compound as a cross-linking agent according to a "three-coat/one-bake" system, as disclosed in Patent Document 1.

The inventors have also confirmed that when the electrodeposition coating and the outer surface of the vehicle are smooth, the effects of the two-component middle coat paint having the isocyanate compound as a cross-linking agent for preventing mixing with the top coat paint are stably demonstrated, and the middle coat coating and the top coat coating do not cure in a state of mixture with each other. The appearance of the coating is therefore improved.

Furthermore, the pre-treatment process is performed after the sanding process in the present invention. A satisfactory electrodeposition coating can therefore be obtained via the electrodeposition coating process and intermediate baking process that are performed after the pre-treatment process.

When the middle coat coating is applied to the electrodeposition coating using the abovementioned middle coat coating paint, the top coat coating is applied, and the top coat coating surface is subjected to final baking, the middle coat coating and the top coat coating do not cure in a state of mixture with each other. A satisfactory finished appearance of the coating can thereby be obtained.

According to a second aspect of the present invention, there is provided a vehicle body production method for coating a body in white of a vehicle body, characterized by comprising: a sanding process for improving the surface roughness of an outer surface of the vehicle body; a pre-treatment process for washing the vehicle body with a fluid; a process for immersing the vehicle body in an electrodeposition bath and applying an electrodeposition coating to the surface of the vehicle body; an intermediate baking process for heating the electrodeposited surface to thereby obtain an electrodeposition coating; a process for applying a middle coat coating on the electrodeposition coating; a process for applying a top coat base coating on the middle coat coated surface; a process for applying a top coat clear coating on the top coat base coated surface; and a final baking process for heating the middle coat coated surface, the top coat base coated surface, and the top coat clear coated surface all together.

Since the sanding process is performed to sand the outer surface of the vehicle body before the pre-treatment process is performed, sanding is performed easily as compare to a polishing of the surface of an electrodeposition coating formed to a thickness of several tens of micrometers, for example.

The present inventors measured the surface roughness of each of an electrodeposition coating obtained by performing electrodeposition coating without sanding prior to pre-treatment, and an electrodeposition coating obtained by performing electrodeposition coating after sanding prior to pre-treatment. The results showed the electrodeposition coating obtained without sanding to have a mean center line roughness Ra (hereinafter indicated simply as "Ra") of 0.25 μm to 0.30 μm. The surface roughness Ra of the electrodeposition coating obtained after sanding was 0.1 μm to 0.15 μm. Specifically, the present inventors confirmed that the surface roughness of the electrodeposition coating is enhanced by performing the sanding process for improving the surface roughness of the outer surface of the vehicle body prior to the pre-treatment process.

Therefore, a smooth top coat clear coating (outermost coating) can be obtained when the middle coat coating, the top coat base coating, and the top coat clear coating are applied on the electrodeposition coating and baking is performed. A vehicle body production method which is capable of improving the coating quality without removing protrusions on an electrodeposition coating can thus be provided.

In the conventional technique, the coating is sometimes polished excessively to remove protrusions from the electrodeposition coating, and the quality of the electrodeposition coating is instead adversely affected. In the present invention, however, since there is no operation that requires special expertise such as polishing an electrodeposition coating having a thickness of about 20 μm, the quality of the electrodeposition coating is no longer reduced.

Preferably, the sanding process is performed by a sanding device provided with a sanding tool for contacting the outer surface of the vehicle body. By thus performing the sanding process using the sanding device, the vehicle body production method is able to saves labor as compared to manual sanding.

In one preferred form, the sanding process comprises sanding an upper surface of the vehicle body using a first sanding device provided with an abrasive belt for contacting the upper surface of the vehicle body, and sanding a side surface of the vehicle body using a second sanding device provided with an abrasive belt for contacting the side surface of the vehicle body. Consequently, the upper surface and side surface of the vehicle body can be automatically sanded by the first and second sanding devices.

Desirably, the sanding process is performed by a sanding robot provided with a sanding tool for contacting the outer surface of the vehicle body. Since the sanding process is performed by the sanding robot, it is readily possible to make the sanding tool follow portions of the outer surface of the vehicle body that vary irregularly when the outer surface of the vehicle body is not flat and varies irregularly.

Preferably, the sanding robot sands an upper surface and a side surface of the vehicle body. The upper surface and side surface of the vehicle body can therefore be sanded by a single sanding robot.

BRIEF DESCRIPTION OF THE DRAWINGS

FIGS. 4A-4C are views showing the operation of a first sanding device, wherein FIG. 4A is a cross-sectional view taken along line 4*a*-4*a* of FIG. 2, FIG. 4B is an enlarged view showing the portion indicated by reference character 4*b* in FIG. 4A prior to sanding, and FIG. 4C is a view showing an upper surface of the vehicle body after sanding;

FIGS. 5A-5C are views showing the operation of a second left-side sanding device, wherein FIG. 5A is a sectional view taken along line 5*a*-5*a* of FIG. 3, FIG. 5B is an enlarged view showing the portion indicated by reference character 5*b* in FIG. 5A prior to sanding, and FIG. 5C is a view showing the side surface of the vehicle body after sanding;

BEST MODE FOR CARRYING OUT THE INVENTION

The preferred embodiments of the present invention are described below with reference to the accompanying drawings, in which a vehicle body comprises a vehicle body for a passenger car (hereinafter referred to simply as "vehicle body").

Figure 1:
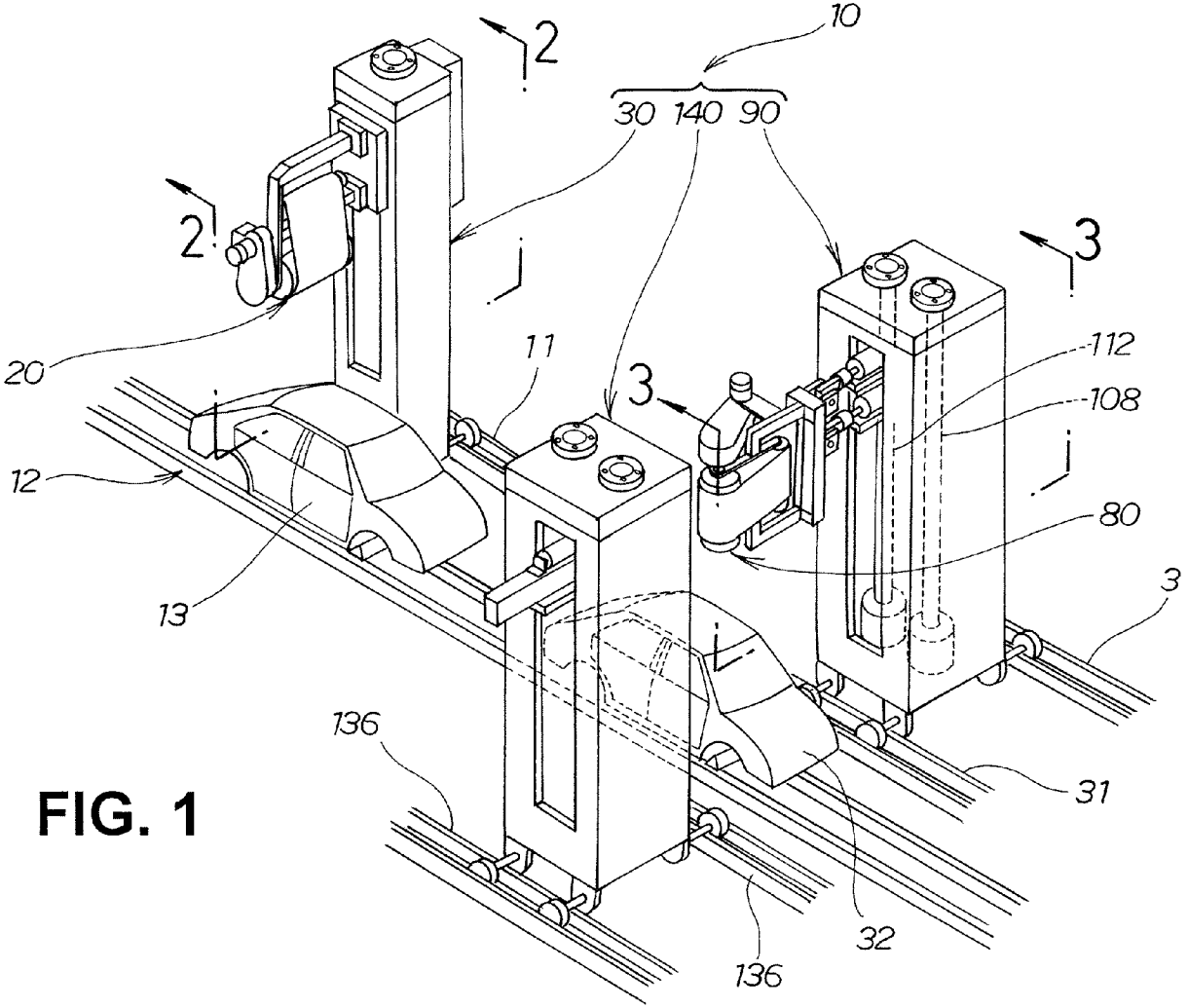
FIG. 1 is a perspective view showing a sanding device used in a method of the present invention.

As shown in FIG. 1, the sanding device 10 is composed of a first sanding device 30 mounted on a rear side rail 11 and having a first sanding mechanism 20 for sanding an upper surface of a first vehicle body 13 mounted on a vehicle body conveyor 12, a second left-side sanding device 90 mounted on rails 31, 31 in front of the first sanding device 30 and having a second left-side sanding mechanism 80 for sanding the left side surface of a second vehicle body 32 mounted on the vehicle body conveyor 12, and a second right-side sanding device 140 mounted on rails 136, 136 on the right side and having a second right-side sanding mechanism for sanding the right side surface of the second vehicle body 32.

Since the second left-side sanding device 90 and the second right-side sanding device 140 have the same structure, only the structure of the second left-side sanding device 90 will be described below, and no description of the structure of the second right-side sanding device 140 will be given.

Figure 2:
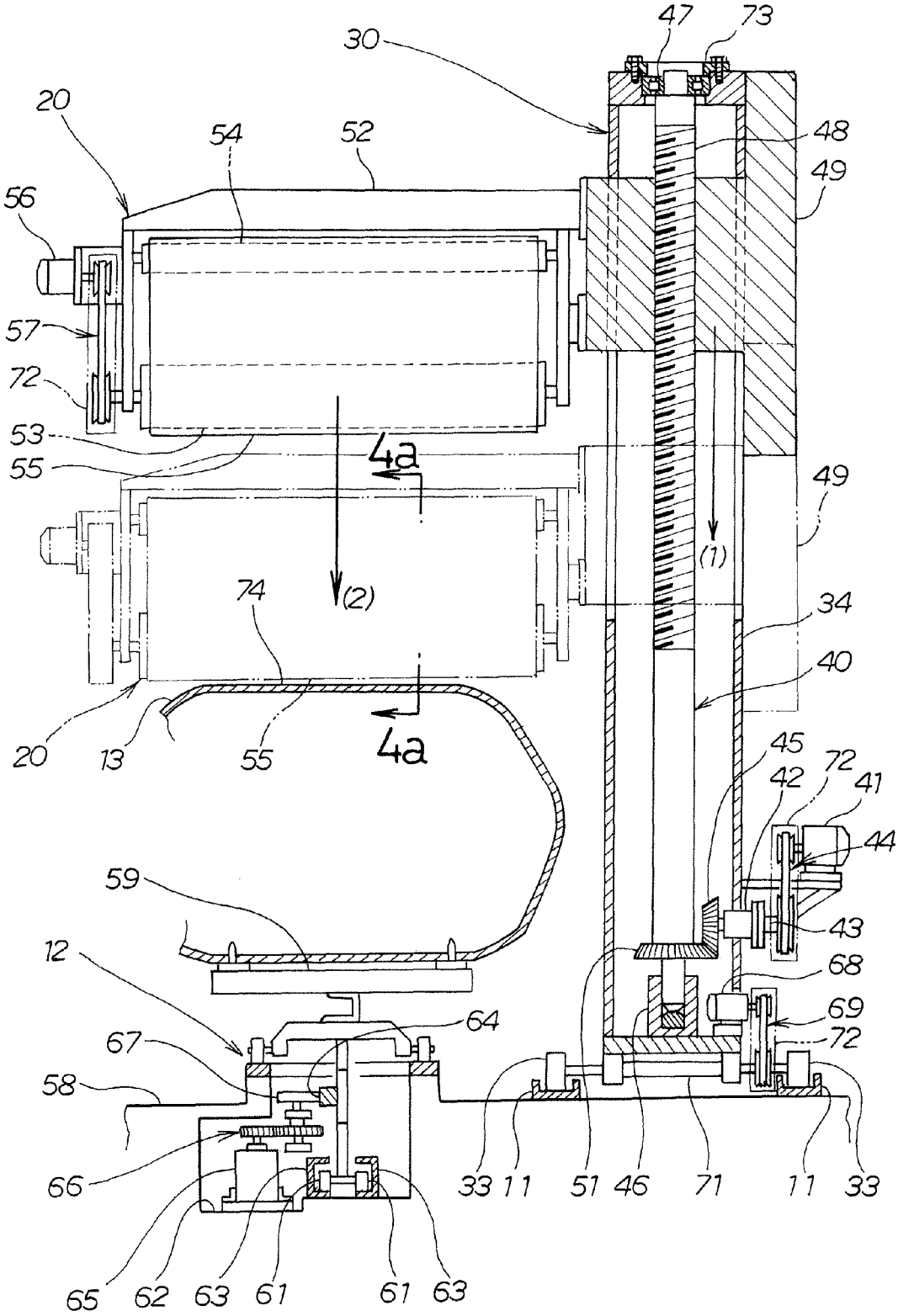
FIG. 2 is an enlarged cross-sectional view taken along line 2-2 of FIG. 1.

As shown in FIG. 2, the first sanding device 30 includes a case 34 formed in an upward orientation and mounted on rails 11, 11 via wheels 33, 33, a first elevator mechanism 40 that is a screw-type mechanism, for example, disposed in the longitudinal direction of the case 34, and the first sanding mechanism 20 coupled to the first elevator mechanism 40.

The first elevator mechanism 40 has an elevator motor 41 supported on a side surface of the case 34, an intermediate shaft 43 supported by a bearing case 42 attached to the case 34, an elevator transmission mechanism 44 coupled to an output shaft of the elevator motor 41 and a front end of the intermediate shaft 43, a drive gear 45 attached to a rear end of the intermediate shaft 43, a lower bearing 46 provided at the bottom of the case 34, an upper bearing 47 provided at the top of the case 34, a screw shaft 48 having an upper end supported by the upper bearing 47 and a lower end supported by the lower bearing 46, a moving block 49 retained by the screw part of the screw shaft 48, and a driven gear 51 meshed with the drive gear 45 and attached to a lower end of the screw shaft 48.

The first elevator mechanism 40 uses a screw shaft 48 in this example, but a rack and pinion, cylinder unit, or the like may also be used.

The first sanding mechanism 20 includes a frame 52 attached to the moving block 49, a contact wheel 53 rotatably mounted on a lower portion of the frame 52, an idler wheel 54 rotatably mounted on an upper portion of the frame 52, an abrasive belt 55 as a sanding tool, for example, suspended so as to be in contact with an outer peripheral surface of the idler wheel 54 and an outer peripheral surface of the contact wheel 53, a sanding motor 56 attached to the frame 52, and a sanding transmission mechanism 57 for interconnecting an output shaft of the sanding motor 56 and an input shaft of the contact wheel 53.

The abrasive belt 55 is described as an example of the sanding means of the first sanding mechanism 20, but a sanding disk or sanding brush may also be used. Wet sanding in which water is supplied during sanding may also be used instead.

The vehicle body conveyor 12 includes a first carriage 59 disposed on a floor and positioning the first vehicle body 13, guide rollers 61, 61 provided on a lower end of the first carriage 59, guide rails 63, 63 provided underground 62 for guiding the guide rollers 61, 61, a power receiving member 64 provided on a lower part of the first carriage 59, a vehicle body conveyance motor 65 provided underground 62, a vehicle body conveyance transmission mechanism 66 coupled to the vehicle body conveyance motor 65, and a friction roller 67 attached to an output shaft of the vehicle body conveyance transmission mechanism 66 and in contact with the power receiving member 64.

The reference numeral 68 denotes a wheel motor, 69 denotes a wheel transmission mechanism, 71 denotes an axle, 72 denotes a safety cover, and 73 denotes a bearing retainer of the screw shaft 48.

When the wheel motor 68 is activated, power of the wheel motor 68 is transmitted to the axle 71 and the wheels 33, 33 via the wheel transmission mechanism 69. The wheels 33, 33 thereby travel on the rails 11, 11, and the first sanding device 30 therefore moves in the direction of the back of the drawing.

When the vehicle body conveyance motor 65 is activated, power of the vehicle body conveyance motor 65 is transmitted to the friction roller 67 via the vehicle body conveyance transmission mechanism 66, and the friction roller 67 therefore rotates. At the same time that the friction roller 67 rotates, power from the friction roller 67 is transmitted to the power receiving member 64, and the first vehicle body 13 and first carriage 59 therefore move in the direction of the back of the drawing.

The contact wheel 53 rotates when the sanding motor 56 is activated while the movement of the first sanding device 30 and the first vehicle body 13 in the direction of the back of the drawing is stopped. The abrasive belt 55 is thereby put in motion, and preparation for sanding is completed.

Then, when the elevator motor 41 is activated, power of the elevator motor 41 is transmitted in sequence to the elevator transmission mechanism 44, the intermediate shaft 43, the drive gear 45, the driven gear 51, and the screw shaft 48. The screw shaft 48 thereby rotates, and the moving block 49 descends to the position indicated by the imaginary lines as indicated by the arrow (1). Since the first sanding mechanism 20 also descends to the position of the imaginary lines indicated by the arrow (2) as the moving block 49 descends, the abrasive belt 55 that had been put in motion comes in contact with an upper surface 74 of the first vehicle body 13. The elevator motor 41 is stopped when the moving block 49 descends to the position of the imaginary lines.

After sanding is completed, the elevator motor 41 is activated and the screw shaft 48 is caused to rotate in the opposite direction from the rotation thereof when the first sanding mechanism 20 was lowered. The first sanding mechanism 20 can thereby be raised to the position indicated by the solid line. The elevator motor 41 is stopped when the first sanding mechanism 20 ascends to the position of the solid line.

Figure 3:
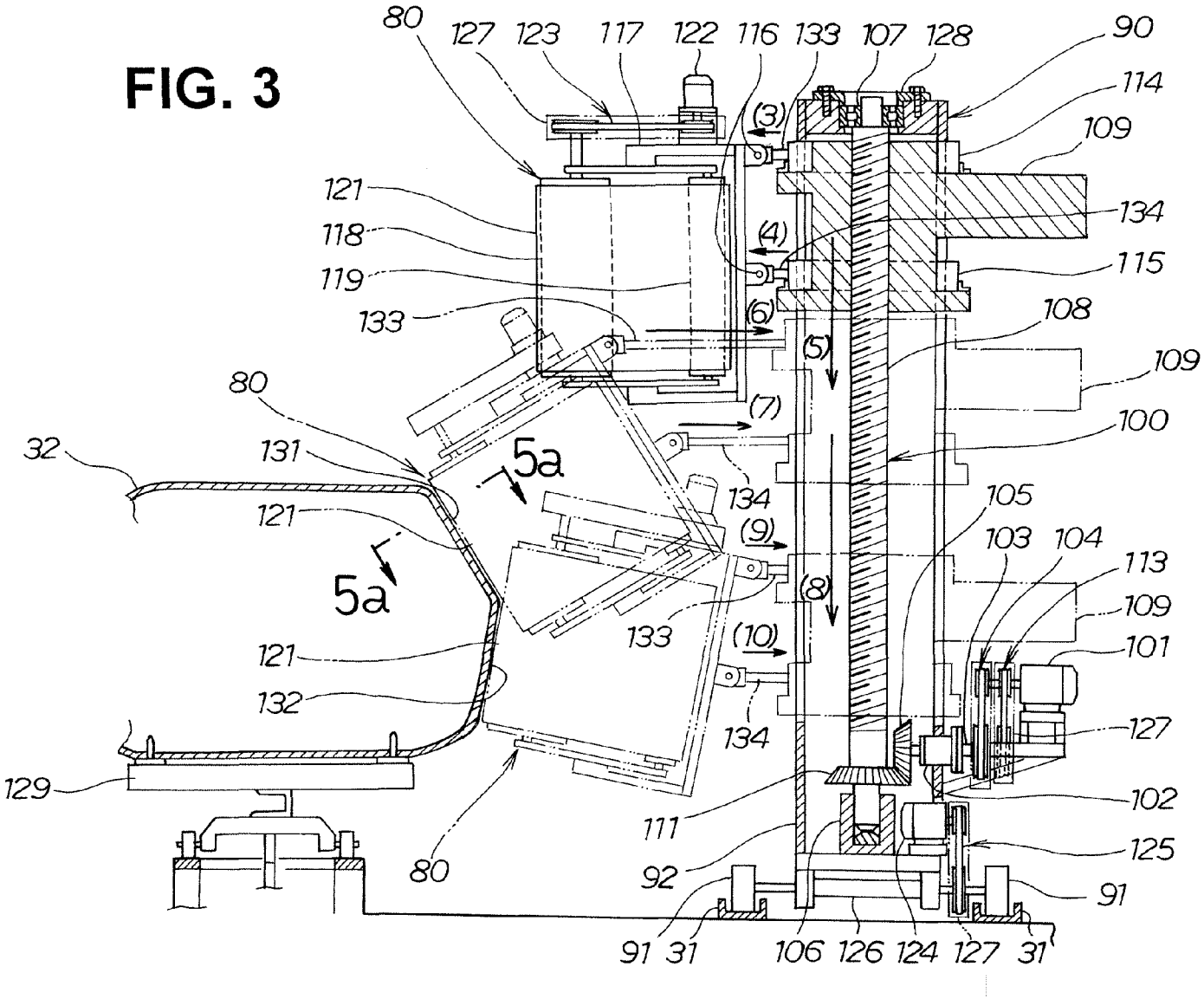
FIG. 3 is an enlarged cross-sectional view taken along line 3-3 of FIG. 1.

As shown in FIG. 3, the second left-side sanding device 90 includes a case 92 mounted on the rails 31, 31 via wheels 91, 91 and formed so as to be oriented upward, the case 92, a second left-side elevator mechanism 100 that is of a screw type, for example, provided on the case 92, and a second left-side sanding mechanism 80 coupled to the second left-side elevator mechanism 100.

The second left-side elevator mechanism 100 has an elevator motor 101 supported on a side surface of the case 92, an intermediate shaft 103 supported by a bearing case 102 attached to the case 92, a front-side elevator transmission mechanism 104 coupled to an output shaft of the elevator motor 101 and a front end of the intermediate shaft 103, a drive gear 105 attached to a rear end of the intermediate shaft 103, a bottom bearing 106 disposed at the bottom of the case 92, an upper bearing 107 disposed on an upper end of the case 92, a front-side screw shaft 108 having an upper end supported by the upper bearing 107 and a lower end supported by the bottom bearing 106, a moving block 109 retained by a screw formed in the front-side screw shaft 108, a driven gear 111 meshed with the drive gear 105 and attached to a lower end of the front-side screw shaft 108, and a rear-side elevator transmission mechanism 113 for driving a rear-side screw shaft 112 (FIG. 1), the rear-side elevator transmission mechanism 113 being coupled to an output shaft of the elevator motor 101.

The second left-side elevator mechanism 100 is a screw-type mechanism in this example, but a rack and pinion, cylinder unit, or the like may also be used, and the configuration of the second left-side elevator mechanism 100 may therefore be modified.

The second left-side sanding mechanism 80 has an upper cylinder unit 114 mounted on an upper end of the moving block 109, a lower cylinder unit 115 mounted on a lower end of the moving block 109, a frame 117 rotatably retained by a pin 116 at each of a distal end of a piston rod of the lower cylinder unit 115 and a distal end of a piston rod of the upper cylinder unit 114, a contact wheel 118 rotatably mounted on a front end of the frame 117; an idler wheel 119 rotatably mounted on a rear part of the frame 117, an abrasive belt 121 as a sanding tool, for example, suspended so as to be in contact with an outer peripheral surface of the idler wheel 119 and an outer peripheral surface of the contact wheel 118, a sanding motor 122 mounted on the frame 117, and a sanding transmission mechanism 123 for interconnecting an output shaft of the sanding motor 122 and an input shaft of the contact wheel 118.

The sanding tool of the second left-side sanding mechanism 80 is described as being an abrasive belt 121, but a sanding disk or sanding brush may also be used, and the sanding tool may therefore be modified. Wet sanding in which water is supplied during sanding may also be used instead.

The reference numeral 124 denotes a wheel motor, 125 denotes a wheel transmission mechanism, 126 denotes an axle, 127 denotes a safety cover, and 128 denotes a bearing retainer.

When the wheel motor 124 is driven, power of the wheel motor 124 is transmitted to the axle 126 and the wheels 91, 91 via the wheel transmission mechanism 125. The wheels 91, 91 thereby travel on the rails 31, 31, and the second left-side sanding mechanism 80 moves in the direction of the back of the drawing.

When the vehicle body conveyance motor 65 (FIG. 2) is driven, the second vehicle body 32 and a second carriage 129 move in the direction of the back of the drawing simultaneously with the first vehicle body 13 (FIG. 2) and the first carriage 59 (FIG. 2).

When the elevator motor 101 is driven, power of the elevator motor 101 is transmitted sequentially to the front-side elevator transmission mechanism 104, the intermediate shaft 103, the drive gear 105, the driven gear 111, and the front-side screw shaft 108. At the same time, the power of the elevator motor 101 is transmitted sequentially to the rear-side elevator transmission mechanism 113, the intermediate shaft, the drive gear, the driven gear, and the rear-side screw shaft 112 (FIG. 1). The front-side screw shaft 108 and the rear-side screw shaft 112 thereby rotate, and the moving block 109 and the second left-side sanding mechanism 80 can therefore be lowered.

The contact wheel 118 rotates when the sanding motor 122 is driven while the movement of the second left-side sanding mechanism 80 and the second vehicle body 32 in the direction of the back of the drawing is stopped. The abrasive belt 121 is thereby put in motion, and preparation for sanding is completed.

An upper piston rod 133 is then pushed out as indicated by the arrow (3), and a lower piston rod 134 is pushed out as indicated by the arrow (4), and the moving block 109 is simultaneously lowered as indicated by the arrow (5) by the drive force of the elevator motor 101. The elevator motor 101 is stopped when the moving block 109 descends to the position of the imaginary lines. As a result, the abrasive belt 121 of the second left-side sanding mechanism 80 comes in contact with an upper side surface 131 of the second vehicle body 32 as indicated by the imaginary lines.

The upper piston rod 133 in the state described above is then withdrawn as indicated by the arrow (6), and the lower piston rod 134 is withdrawn as indicated by the arrow (7), and the moving block 109 is simultaneously lowered as indicated by the arrow (8) by the drive force of the elevator motor 101. The elevator motor 101 is stopped when the moving block 109 descends to the position of the imaginary lines. As a result, the abrasive belt 121 of the second left-side sanding mechanism 80 comes in contact with a lower side surface 132 of the second vehicle body 32.

After sanding is completed, the upper piston rod 133 is withdrawn as indicated by the arrow (9), and the lower piston rod 134 is withdrawn as indicated by the arrow (10). The elevator motor 101 is driven, and the front-side screw shaft 108 and rear-side screw shaft 112 (FIG. 1) are caused to rotate in the opposite direction from the rotation thereof when the second left-side sanding mechanism 80 was lowered. The second left-side sanding mechanism 80 can thereby be raised to the position indicated by the solid line. The elevator motor 101 is stopped when the second left-side sanding mechanism 80 ascends to the position of the solid line.

The operation of the first sanding device and second left-side sanding device configured as described above will next be described.

Figure 4A:
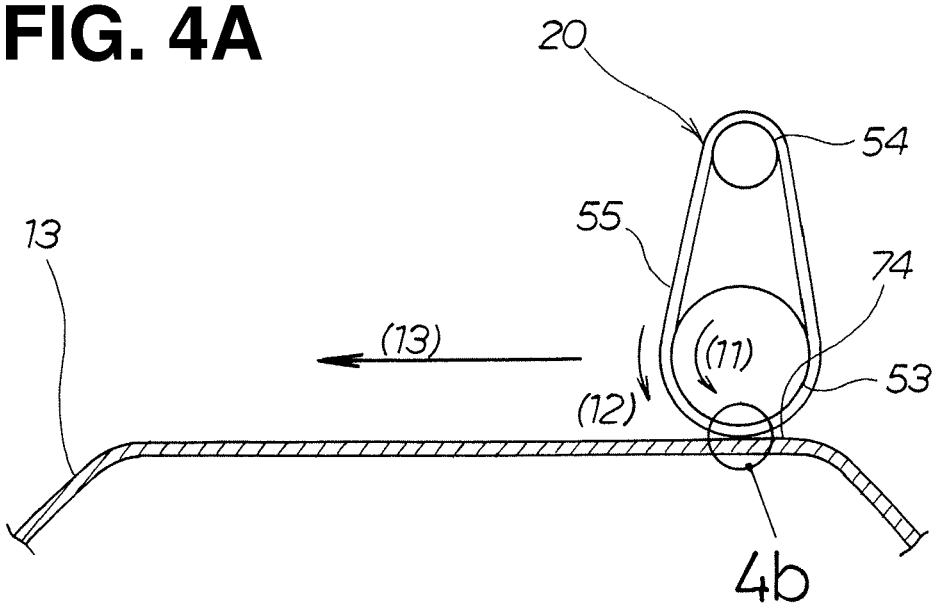
Figure 4B:
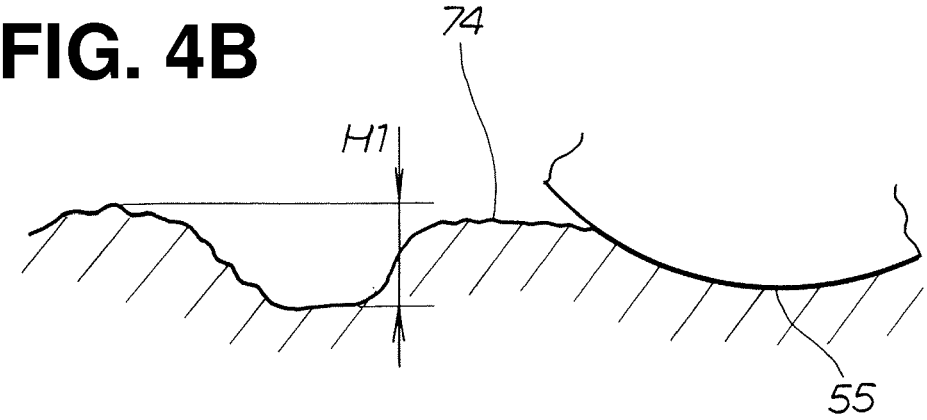
Figure 4C:
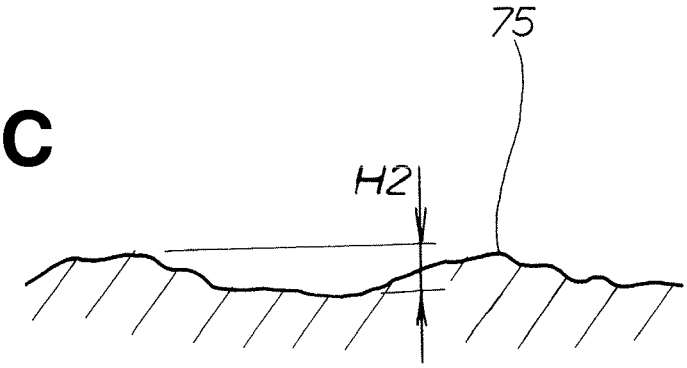

FIG. 4A through 4C show the operation of the first sanding device 30, and FIG. 4A is a cross-sectional view taken along line 4*a*-4*a* of FIG. 2. The contact wheel 53 rotates as indicated by the arrow (11), and the abrasive belt 55 fed as indicated by the arrow (12) is thereby brought into contact with the upper surface 74 of the first vehicle body 13. The first sanding mechanism 20 in this state is then moved as indicated by the arrow (13).

FIG. 4B is an enlarged view showing the portion indicated by reference character 4*b* in FIG. 4A. Sanding is accomplished by bringing the abrasive belt 55 into contact with extremely minute irregularities on the upper surface 74. The reference character H1 denotes a dimension indicating the height difference of the surface irregularities prior to sanding.

FIG. 4C shows the upper surface 75 after sanding. The reference character H2 denotes a dimension indicating the height difference of the surface irregularities after sanding. By comparison of the height difference dimensions in FIGS. 4B and 4C, it is apparent that the height difference dimension H2 after sanding is smaller than the height difference dimension H1 prior to sanding.

The present inventors measured the surface roughness of each of an electrodeposition coating obtained by performing electrodeposition coating without sanding prior to pre-treatment, and an electrodeposition coating obtained by performing electrodeposition coating after sanding prior to pre-treatment. The result showed the electrodeposition coating obtained without sanding to have a surface roughness Ra1 of 0.25 μm to 0.30 μm. The surface roughness Ra2 of the electrodeposition coating obtained after sanding was 0.1 μm to 0.15 μm. Specifically, the present inventors confirmed that the surface roughness of the electrodeposition coating is enhanced by sanding for improving the surface roughness of the outer surface of the vehicle body prior to the pre-treatment process.

If Ra1=0.25 μm to 0.30 μm is obtained from the height difference dimension H1 prior to sanding, and Ra2=0.1 μm to 0.15 μm is obtained from the height difference dimension H2 after sanding, then it is apparent that the surface roughness of the electrodeposition coating can be enhanced by sanding with the first sanding device 30 (FIG. 2) prior to pre-treatment.

Figure 5A:
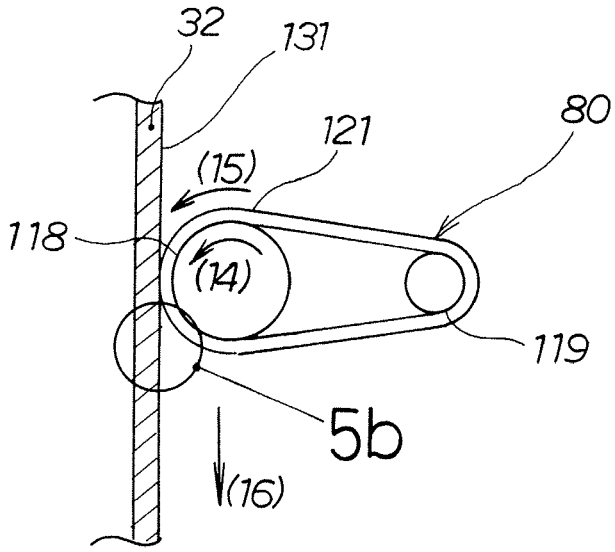
Figure 5B:
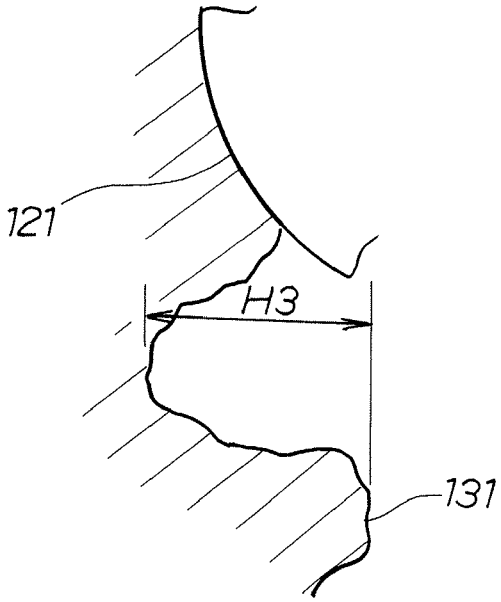
Figure 5C:
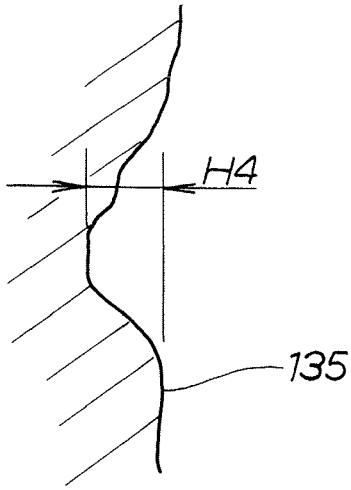

FIGS. 5A through 5C show the operation of the second left-side sanding device 90, and FIG. 5A is a cross-sectional view taken along line 5*a*-5*a* of FIG. 3. The contact wheel 118 rotates as indicated by the arrow (14), and the abrasive belt 121 fed as indicated by the arrow (15) is thereby brought into contact with the upper side surface 131 of the second vehicle body 32. The second left-side sanding mechanism 80 in this state is then moved as indicated by the arrow (16).

FIG. 5B is an enlarged view showing the portion indicated by reference character 5*b* in FIG. 5A. Sanding is accomplished by bringing the abrasive belt 121 into contact with the extremely minute irregularities on the upper side surface 131. The reference symbol H3 refers to a dimension indicating the height difference of the surface irregularities prior to sanding.

FIG. 5 5C shows the upper side surface 135 after sanding. The reference symbol H4 refers to a dimension indicating the height difference of the surface irregularities after sanding. By comparison of the height difference dimensions in FIGS. 5B and 5C, it is apparent that the height difference dimension H4 after sanding is smaller than the height difference dimension H3 prior to sanding.

The present inventors measured the surface roughness of each of an electrodeposition coating obtained by performing electrodeposition coating without sanding prior to pre-treatment, and an electrodeposition coating obtained by performing electrodeposition coating after sanding prior to pre-treatment. The result showed the electrodeposition coating obtained without sanding to have a surface roughness Ra3 of 0.25 μm to 0.30 μm. The surface roughness Ra4 of the electrodeposition coating obtained after sanding was 0.1 μm to 0.15 μm. Specifically, the present inventors confirmed that the surface roughness of the electrodeposition coating is enhanced by performing the sanding process for improving the surface roughness of the outer surface of the vehicle body prior to the pre-treatment process.

If Ra3=0.25 μm to 0.30 μm is obtained from the height difference dimension H3 prior to sanding, and Ra4=0.1 μm to 0.15 μm is obtained from the height difference dimension H4 after sanding, then it is apparent that the surface roughness of the electrodeposition coating can be enhanced by sanding with the second left-side sanding device 90 (FIG. 3) prior to pre-treatment.

The abovementioned results were described as being obtained by application to the upper side surface 131 of the second vehicle body 32, but the same results can be obtained by application to the lower side surface 132 (FIG. 3) of the second vehicle body 32.

The vehicle body production method performed using the sanding device described above will next be described based on FIG. 6 and with reference to FIGS. 4A-4C and 5A-5C.

Figure 6:
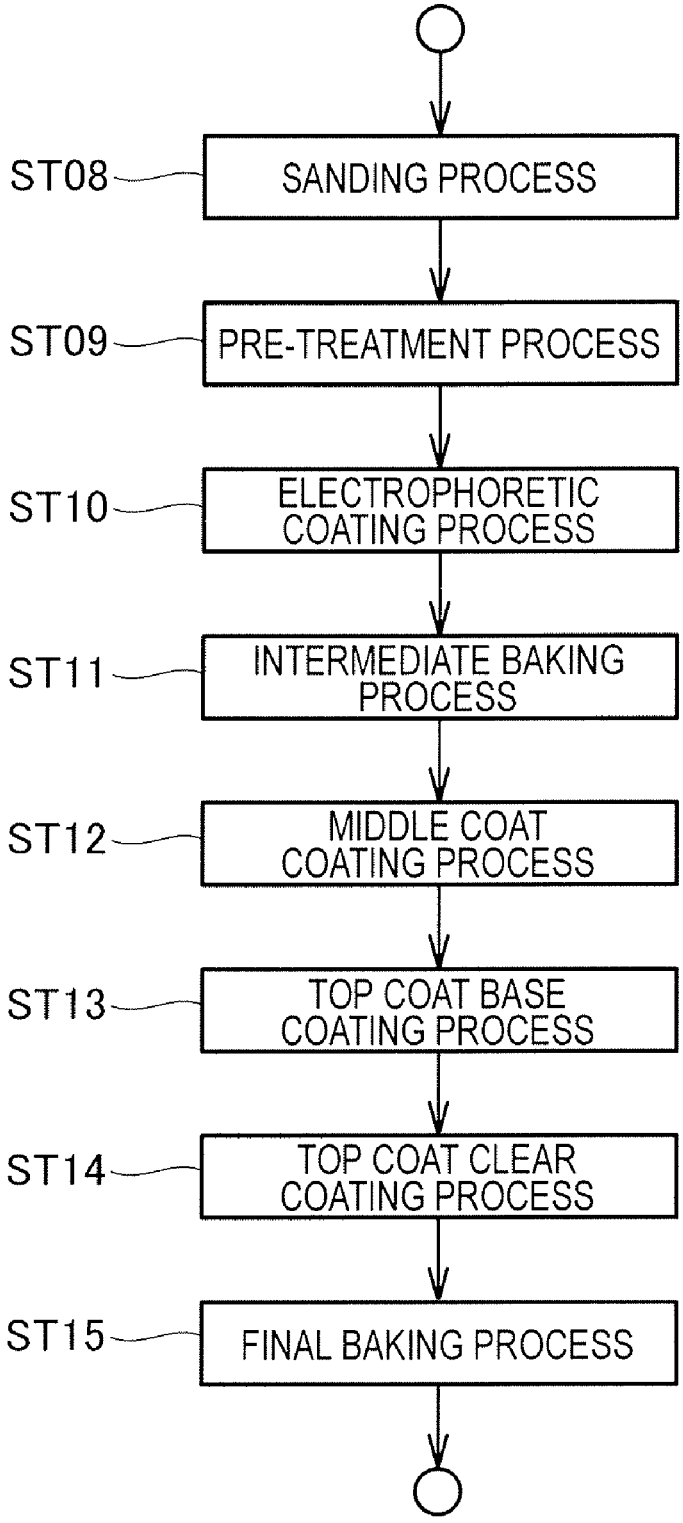
FIG. 6 is a flowchart showing a production method according to the present invention.

In FIG. 6, the outer surface of the vehicle body is sanded in ST08. Specifically, the upper surface 74 of the first vehicle body 13 is sanded by the abrasive belt 55 of the first sanding mechanism 20 as shown in FIGS. 4A-4C. The upper side surface 131 of the second vehicle body 32 is also sanded by the abrasive belt 121 of the second left-side sanding mechanism 80 as shown in FIGS. 5A-5C.

In ST09, the vehicle body is washed with an acidic solution and an alkaline solution. Specifically, the present invention is characterized by comprising the sanding process described in ST08 for improving the surface roughness of the outer surface of the vehicle body prior to the pre-treatment process of degreasing and washing the vehicle body.

By performing the sanding process prior to the pre-treatment process, there is no need to add a washing process and a drying process after sanding of the vehicle body, and the vehicle body production method is able to use a compact coating line. The vehicle body production method is further able to save energy and reduce the amount of emitted $CO_2$. In other words, washing and other processing after sanding of the vehicle body can be accomplished by the washing in the pre-treatment process.

In ST10, the vehicle body is immersed in an electrodeposition coating bath, and an electrodeposition coating is applied to the surface of the vehicle body.

In ST11, the electrodeposited surface is heated for 20 minutes at 170° C., for example, and an electrodeposition coating is obtained.

In ST12, a middle coat coating is applied on the electrodeposition coating.

In ST13, a top coat base coating is applied on the middle coat coated surface.

In ST14, a top coat clear coating is applied on the top coat base coated surface.

In ST15, the middle coat coated surface, the top coat base coated surface, and the top coat clear coated surface are heated all together for 30 minutes at 140° C., for example.

The heating temperature and heating times described in ST11 and ST15 are arbitrary and not limited to the temperatures and times described above.

In this vehicle body production method, the sanding process is a process of sanding the outer surface of the vehicle body prior to the pre-treatment process. Therefore, in the abovementioned sanding process, sanding can be performed with less trouble as compared to the polishing the surface of the electrodeposition coating formed to have a thickness of several tens of micrometers, for example.

The present inventors confirmed that the surface roughness of the electrodeposition coating is enhanced by performing the sanding process for improving the surface roughness of the outer surface of the vehicle body prior to the pre-treatment process, as described above with reference to FIGS. 4 and 5. Specifically, the surface roughness Ra=0.1 μm to 0.15 μm obtained by sanding the outer surface of the vehicle body is enhanced relative to the surface roughness Ra=0.25 μm to 0.30 μm of the electrodeposition coating in the case where the outer surface of the vehicle body is not sanded.

Therefore, a smooth top coat clear coating (outermost coating) can be obtained when the middle coat coating, the top coat base coating, and the top coat clear coating are applied on the electrodeposition coating and baking is performed. A vehicle body production method, which is capable of improving the coating quality without requiring removing of protrusions on electrodeposition coating, can thus be provided.

In the conventional technique, the coating is sometimes polished excessively to remove protrusions from the electrodeposition coating, and the quality of the electrodeposition coating is instead adversely affected. In the present invention, however, since there is no operation that requires special expertise such as sanding an electrodeposition coating having a thickness of about 20 μm, the quality of the electrodeposition coating is no longer deteriorated.

As shown in FIG. 1, the sanding process of the present invention is performed by the first sanding device 30 provided with the abrasive belt 55 for coming in contact with the upper surface 74 of the first vehicle body 13, the second left-side sanding device 90 provided with the abrasive belt 121 for coming in contact with the left side surface of the second vehicle body 32, and the second right-side sanding device 140 provided with a abrasive belt for coming in contact with the right side surface of the second vehicle body 32. By thus performing the sanding process using the sanding devices 30, 90, 140, the vehicle body production method of the invention is able to save labor as compared to a manual sanding process.

The middle coat paint used in the middle coat coating performed in ST12 of FIG. 6 is characterized in comprising a two-component material that has an isocyanate compound as a cross-linking agent.

As described in paragraph [0033] of the specification of Patent Document 1 (Japanese Patent Application Laid-open Publication No. 2007-229671) filed previously, the present inventors have confirmed that the middle coat coating and top coat coating can be prevented from curing in a state of mixture with each other by using a two-component middle coat coating paint having an isocyanate compound as a cross-linking agent in a "three-coat/one-bake" system.

In the present invention, the pre-treatment process of ST09 is performed after the sanding process of ST08. A satisfactory electrodeposition coating can therefore be obtained via the electrodeposition coating process of ST10 and intermediate baking process of ST11 subsequent to the pre-treatment process.

When the middle coat coating is applied to the electrodeposition coating in ST12 using the abovementioned middle coat coating paint, the top coat coating is applied in ST13 and ST14, and the top coat coating surface is subjected to final baking in ST15, the middle coat coating and the top coat coating do not cure in a state of mixture with each other. A satisfactory finished appearance of the coating can thereby be obtained.

A comparison of the present embodiment with a prior art example of a coating after final baking will next be described with reference to FIGS. 7A-7B.

Figure 7A:
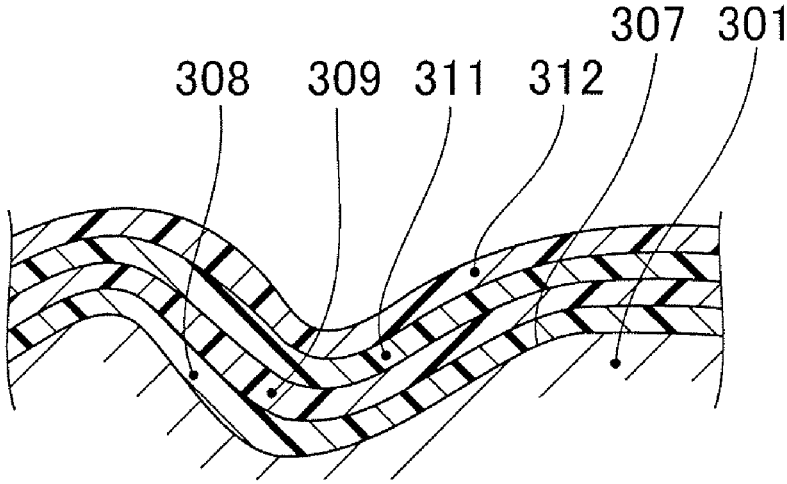
FIGS. 7A-7B are views showing a conventional coating and an inventive coatings, respectively, that are obtained after final baking.

FIG. 7A shows the prior art example. An electrodeposition coating 308, a middle coat coating 309, a top coat base coating 311, and a top coat clear coating 312 are formed in sequence on the upper surface 307 of a vehicle body 301 that is not sanded prior to pre-treatment.

Since the irregularities on the upper surface 307 of the vehicle body 301 are large, the coatings 308, 309, 311, 312 exhibit an undulating shape. The present inventors confirmed that the middle coat coating and the top coat coatings cured in a state of mixture with each other due to the undulating shape, and the appearance of the coating was adversely affected.

Figure 7B:
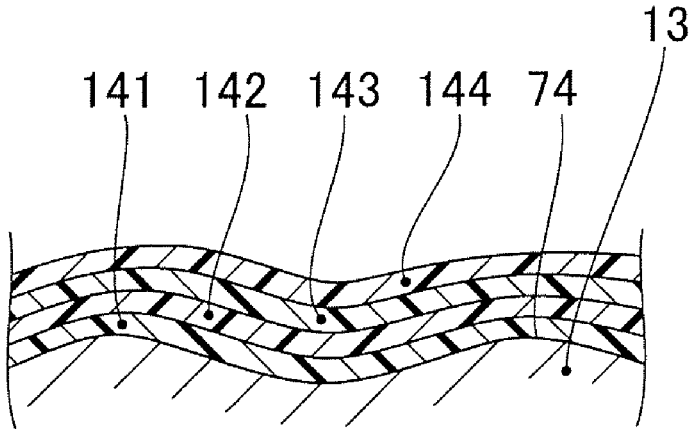

FIG. 7B shows the present embodiment. An electrodeposition coating 141, a middle coat coating 142, a top coat base coating 143, and a top coat clear coating 144 are formed in sequence on the upper surface 74 of the vehicle body 13 that has been subjected to the sanding process prior to the pre-treatment process. The irregularities on the upper surface 74 of the vehicle body 13 in this instance are small. Specifically, the upper surface 74 is a nearly smooth surface. The coatings 141, 142, 143, 144 therefore exhibit a nearly smooth state.

The present inventors confirmed that when the upper surface 74 and the electrodeposition coating 141 are smooth, the two-component middle coat coating paint having an isocyanate compound as a cross-linking agent is able to stably perform a function to prevent mixing with the top coat paint, and the middle coat coating and top coat coating do not cure in a state of mixture with each other. The appearance of the coating is therefore enhanced.

It is apparent by comparison between FIG. 7A and FIG. 7B that the appearance of the coating can be better enhanced by performing the sanding process for improving the surface roughness of the upper surface 74 of the vehicle body 13 prior to the pre-treatment process, as shown in FIG. 7B.

The outer surface of the vehicle body has portions that are not smooth and that vary irregularly. A machine capable of following the irregular variations must be used in order to sand such portions. Therefore, an example in which the outer surface of a vehicle body is sanded by a robot will next be described.

Figure 8:
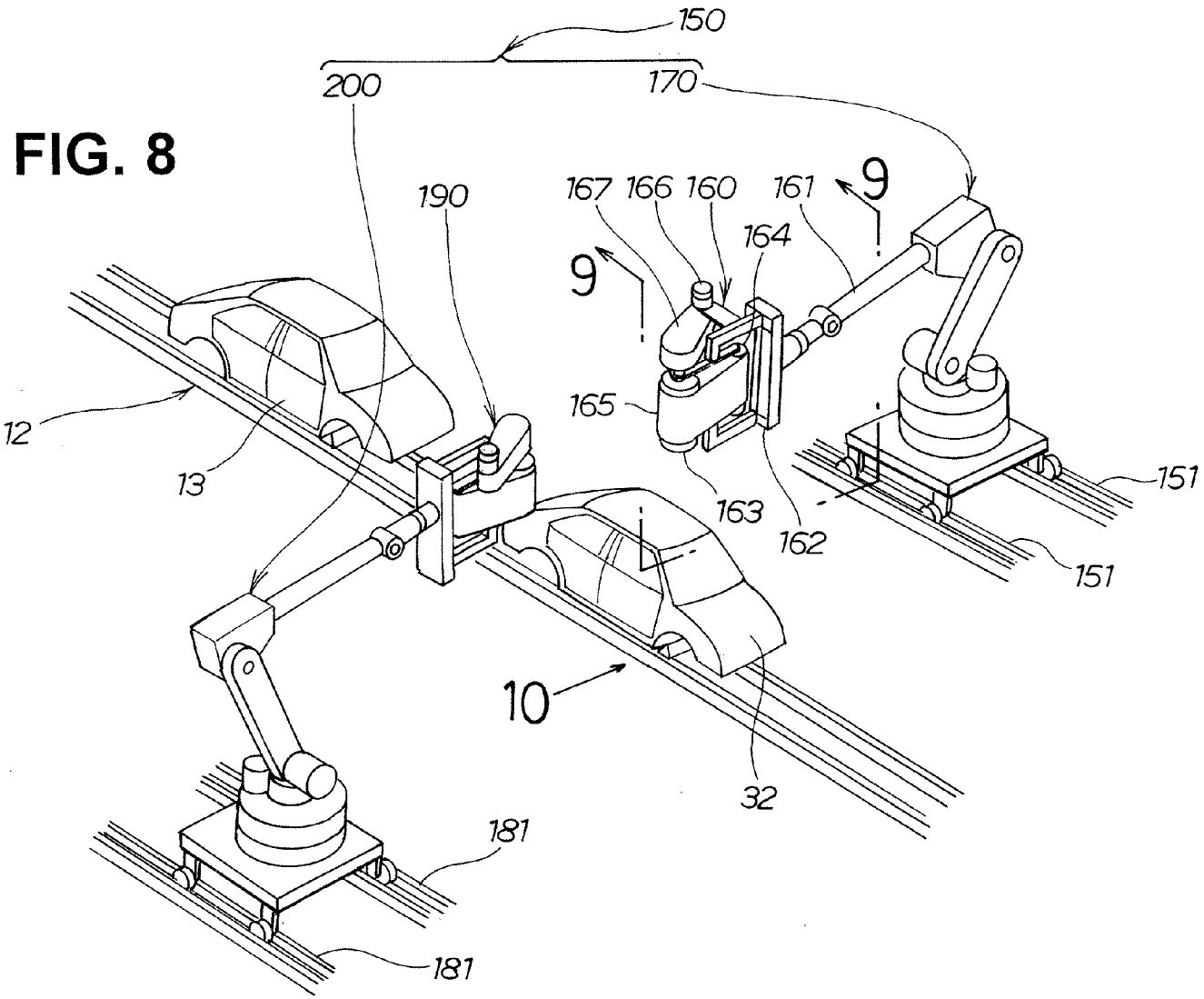
FIG. 8 is a perspective view showing the use of sanding robots.

FIG. 8 shows an example in which the outer surface of a vehicle body is sanded by a robot. The same reference characters are used in FIG. 8 to refer to members that are the same as in FIG. 1, and such members will not be described. The main point of difference is that the sanding mechanisms provided with the abrasive belts are mounted on robots.

The sanding robot 150 is composed of a left sanding robot 170 mounted on left-side rails 151, 151 and having a left sanding mechanism 160 (described in detail hereinafter) for sanding the outer surface of the second vehicle body 32 mounted on the vehicle body conveyor 12, and a right sanding robot 200 mounted on right-side rails 181, 181 and having a right sanding mechanism 190 for sanding the outer surface of the second vehicle body 32 mounted on the vehicle body conveyor 12.

The left sanding mechanism 160 includes a frame 162 mounted on a distal end of a robot arm 161, a contact wheel 163 rotatably mounted to a front end of the frame 162, an idler wheel 164 rotatably mounted to a rear end part of the frame 162, an abrasive belt 165 as a sanding tool, for example, suspended so as to be in contact with an outer peripheral surface of the idler wheel 164 and an outer peripheral surface of the contact wheel 163, a sanding motor 166 mounted to the frame 162, and a safety cover 167 covering a sanding transmission mechanism for interconnecting an output shaft of the sanding motor 166 and an input shaft of the contact wheel 163.

The sanding tool of the left sanding mechanism 160 is described as being an abrasive belt 165, but a sanding disk or sanding brush may also be used, and the sanding tool may therefore be modified. Wet sanding in which water is supplied during sanding may also be used instead.

The structure of the right sanding mechanism 190 is the same as the structure of the left sanding mechanism 160 and therefore will not be described.

Figure 9:
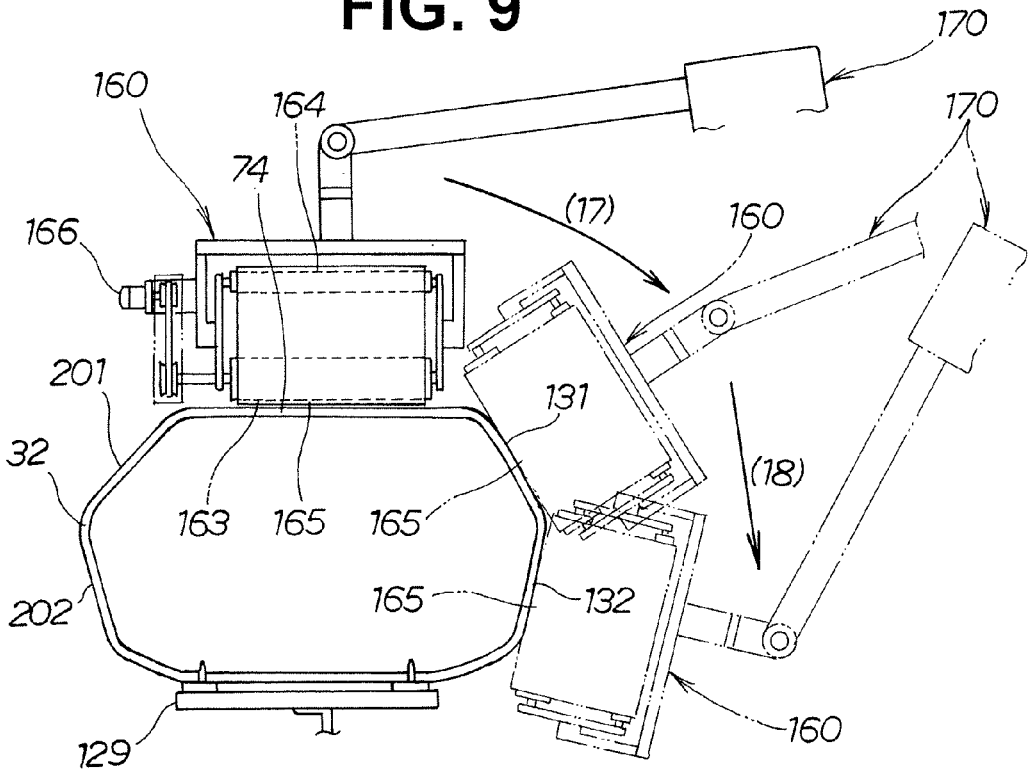
FIG. 9 is a cross-sectional view taken along line 9-9 of FIG. 8.
Figure 10:
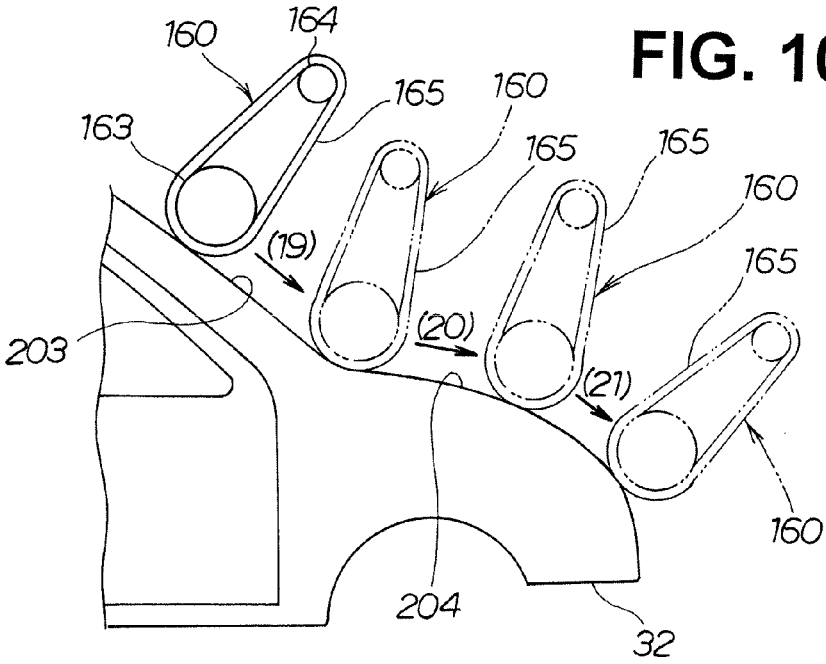
FIG. 10 is a view showing the portion indicated by reference numeral 10 in FIG. 8.
Figure 11:
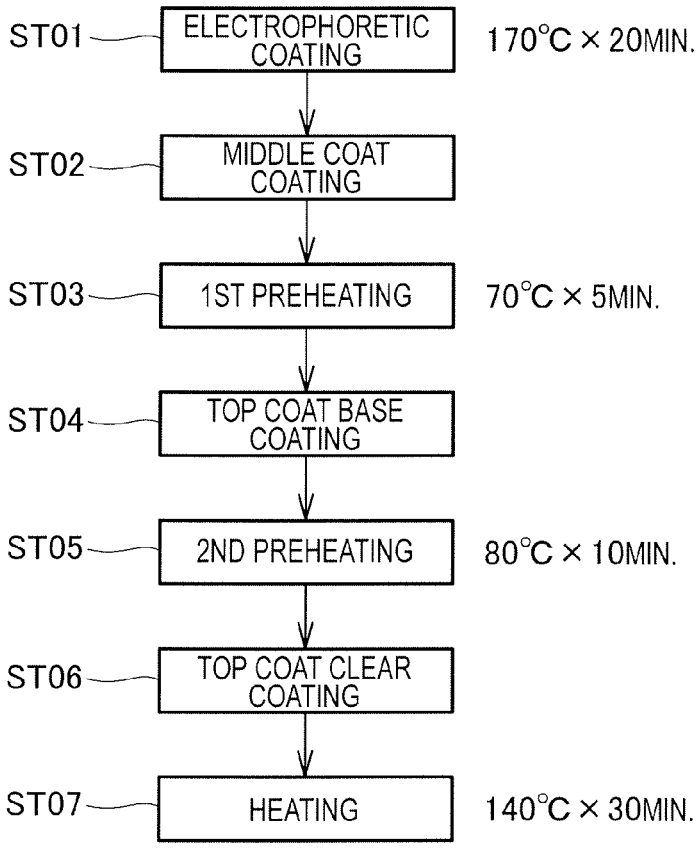
FIG. 11 is a flowchart showing a conventional vehicle body production method.
Figure 12:
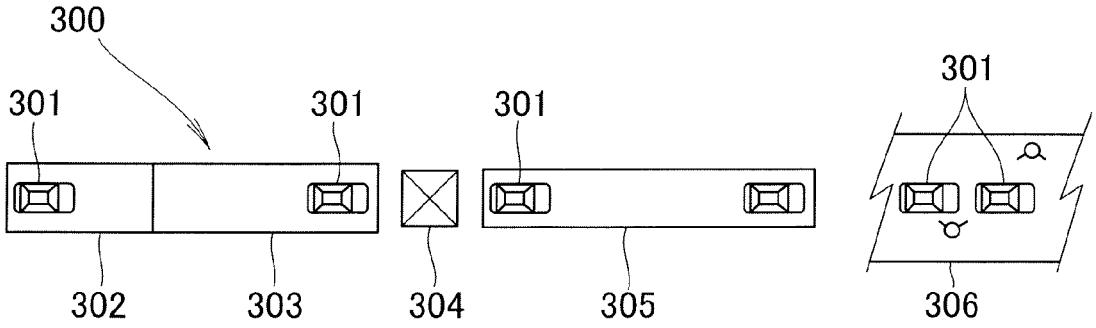
PRIOR ART FIG. 12
FIG. 12 is a schematic view showing the conventional vehicle body production method that includes a polishing operation.

The operation of the sanding robot will next be described with reference to FIGS. 9 and 10. In FIGS. 9 and 10, the left sanding mechanism 160 is positioned above the second vehicle body 32. The abrasive belt 165 is described as being already put in motion by the drive force of the sanding motor 166.

As shown in FIG. 9, the left sanding robot 170 sands the upper surface 74 by causing the abrasive belt 165 of the left sanding mechanism 160 to come in contact with the upper surface 74 of the second vehicle body 32. Once sanding of the upper surface 74 is completed, the left sanding mechanism 160 is moved as indicated by the arrow (17) by the action of the left sanding robot 170, and the upper side surface 131 is sanded by the abrasive belt 165 as indicated by the imaginary lines.

Once sanding of the upper side surface 131 is completed, the left sanding mechanism 160 is moved as indicated by the arrow (18) by the action of the left sanding robot 170, and the lower side surface 132 is sanded by the abrasive belt 165 as indicated by the imaginary lines.

The upper side surface 201 and lower side surface 202 on the right side of the second vehicle body 32 are sanded by the right sanding robot 200 (FIG. 8).

As described above, the left sanding robot 170 is capable of sanding the upper surface 74, upper side surface 131, and lower side surface 132 of the second vehicle body 32 using a single device. The efficiency of the sanding operation can therefore be enhanced.

FIG. 10 shows the state in which the outer surface of a front pillar 203 of the second vehicle body 32 is sanded by the left sanding mechanism 160. Once sanding of the front pillar 203 is completed, the outer surface of a hood 204 is sanded by the abrasive belt 165 indicated by the imaginary lines in the sequence of the arrows (19), (20), and (21) by the action of the left sanding robot 170.

Since sanding is performed by the left sanding robot 170, the abrasive belt 165 can easily be made to follow the portions of the outer surface of the second vehicle body 32 that vary irregularly when the outer surface of the second vehicle body 32 is not flat and varies irregularly.

The sanding process in ST08 of FIG. 6 is characterized by being performed by a sanding robot provided with an abrasive belt for contacting the outer surface of a vehicle body.

The abrasive belt can therefore easily be made to follow portions of the outer surface of the vehicle body that vary irregularly when the outer surface of the vehicle body is not flat and varies irregularly.

The vehicle body of the present invention was described as being that of a passenger car in the embodiments, but the present invention can also be applied to a bus or truck, and need not necessarily be applied to a common automobile.

INDUSTRIAL APPLICABILITY

The vehicle body production method of the present invention is suitable for use in the coating process of a passenger car.

The invention claimed is:

1. A method for producing a vehicle body in which a middle coat coating and a top coat coating are applied to a vehicle body after the vehicle body has been subjected to a pre-treatment process where the vehicle body is degreased, washed, or subjected to other treatments, the vehicle body production method comprising: a sanding process for improving the surface roughness of an outer surface of the vehicle body prior to a degreasing process where the vehicle body is degreased;

wherein said sanding process is exclusively performed prior to said degreasing process.

2. The vehicle body production method of claim 1, wherein a middle coat coating paint used in the middle coat coating is a two-component paint having an isocyanate compound as a cross-linking agent.

3. A vehicle body production method for coating a body in white of a vehicle body, comprising the method steps performed in the following sequential order:

a sanding process for improving the surface roughness of an outer surface of the vehicle body;

a pre-treatment process for degreasing the vehicle body and washing the degreased vehicle body with a fluid;

a process for immersing the vehicle body in an electrodeposition bath and applying an electrodeposition coating to the surface of the vehicle body;

an intermediate baking process for heating the electrodeposited surface to thereby obtain an electrodeposition coating;

a process for applying a middle coat coating on the electrodeposition coating;

a process for applying a top coat base coating on the middle coat coated surface;

a process for applying a top coat clear coating on the top coat base coated surface; and a final baking process for heating the middle coat coated surface, the top coat base coated surface, and the top coat clear coated surface all together;

wherein said sanding process is always performed prior to said pre-treatment process for degreasing.

4. The vehicle body production method of claim 3, wherein the sanding process is performed by a sanding device provided with a sanding tool for contacting the outer surface of the vehicle body.

5. The vehicle body production method of claim 3, wherein the sanding process comprises sanding an upper surface of the vehicle body using a first sanding device provided with an abrasive belt for contacting the upper surface of the vehicle body; and sanding a side surface of the vehicle body using a second sanding device provided with an abrasive belt for contacting the side surface of the vehicle body.

6. The vehicle body production method of claim 3, wherein the sanding process is performed by a sanding robot provided with a sanding tool for contacting the outer surface of the vehicle body.

7. The vehicle body production method of claim 6, wherein the sanding robot sands an upper surface and a side surface of the vehicle body.

* * * * *